United States Patent [19]

Stone

[11] 4,396,116

[45] Aug. 2, 1983

[54] BASKET-TYPE CARRIER FOR BOTTLES

[75] Inventor: Orison W. Stone, Middlebury, Vt.

[73] Assignee: Pack Image, Inc., Middlebury, Vt.

[21] Appl. No.: 270,108

[22] Filed: Jun. 3, 1981

[51] Int. Cl.[3] ..... B65D 75/00

[52] U.S. Cl. ..... 206/162; 206/170; 206/174; 206/175; 206/427; 206/28 BC

[58] Field of Search ..... 206/139, 141, 142, 143, 206/162, 188, 187, 180, 191, 193, 195, 198, 427, 168, 140, 163, 166, 167, 164, 181, 186, 165, 170–175, 429; 229/28 BC, 52 B, 52 BC, 41 R

[56] References Cited

U.S. PATENT DOCUMENTS

| | | | |
|---|---|---|---|
| 2,795,365 | 6/1957 | Currie | 206/427 |
| 3,236,439 | 2/1966 | Johnson et al. | 229/27 |
| 3,363,824 | 1/1968 | Murata | 229/27 |
| 3,955,745 | 5/1976 | Forrer | 229/30 |
| 4,034,852 | 7/1977 | Forrer | 206/141 |
| 4,096,985 | 6/1978 | Wood | 229/40 |
| 4,234,081 | 11/1980 | Champlin | 206/147 |
| 4,240,546 | 12/1980 | Stone | 206/193 |
| 4,278,168 | 7/1981 | Wood | 206/183 |
| 4,284,195 | 8/1981 | Champlin | 206/166 |
| 4,324,328 | 5/1982 | Champlin | 206/194 |

FOREIGN PATENT DOCUMENTS

| | | | |
|---|---|---|---|
| 2933613 | 1/1980 | Fed. Rep. of Germany | 229/28 BC |

*Primary Examiner*—Joseph Man-Fu Moy
*Assistant Examiner*—David Fidei
*Attorney, Agent, or Firm*—Wood, Herron & Evans

[57] ABSTRACT

A carrier for bottles is formed from a paperboard tube having top, bottom and end walls. The upper corners of the tube are gusseted so that the top wall may be swung downwardly on each side of a center line to form a center partition. The end walls have serially-connected, minor flaps and double thickness dividers which are swung inwardly around bottles at the four corners of the carrier with the dividers creating three cells on each side of the carrier. A major flap is hinged to each side of the bottom wall and is glued to the minor flaps to complete the formation of the carrier. The end walls are provided with a transverse fold line or crease which provides advantages in gluing of the carrier as well as the erecting of the carrier.

4 Claims, 10 Drawing Figures

BASKET-TYPE CARRIER FOR BOTTLES

This invention relates to a bottle carrier, and more particularly, to a basket-type carrier designed for glass bottles.

In general, a basket-type carrier has a bottom wall, side and end walls, a center partition, and transverse dividers to form three cells on each side of the center partition. I.C.C. regulations require that bottles be separated from each other by a minimum of 0.040 inch (40 point) thickness of board. It is therefore customary to manufacture the carrier from 21 point board and design the carrier so as to provide double thicknesses of board in those areas which space the bottles apart.

These design requirements have generated very complex, flat blanks having multiple, rather precisely positioned, glue spots to permit doubling over of paperboard sections as well as the other forming steps. The complex pattern of glue spots has required timed gluers which are able to deposit glue in the desired pattern. The converting machines which employ timed gluers are slow and expensive.

The carrier resulting from this complexity is functional but not particularly attractive. It has some additional disadvantages, included among which is the fact that it is structurally weak and in particular its bottom wall sags away from the rest of the structure when loaded with bottles.

It has been the objective of the invention of my U.S. Pat. No. 4,240,546 to provide a carrier which is an improvement over the foregoing carrier and which has the following features:

(a) improved strength;
(b) an improved sculptured appearance;
(c) reduced complexity and capability of being run on a faster untimed straight line gluer;
(d) an improved comfortable handle;
(e) improved bottle cushioning to further minimize breakage.

This objective and these improved features are attained by several structural features of the carrier and the method of forming it. The carrier is first formed as a tube having a bottom wall, end walls and a top wall.

The upper four corners of the tube are provided with a gusset structure consisting of triangular gusset panels taken from the end wall. The apexes of the gusset panels are spaced from each other at the central portion of the top wall in order to create the sculptured effect referred to above and to provide ready removability of full or empty bottles from the carrier.

The two sides of the top wall are folded downwardly through approximately 90° to form a two-ply center partition. The two plies are folded on a center fold line which does not extend all the way to each end wall. The ends of the fold line cooperate with the apexes of the gusset structure to create at each end of the carrier a curved triangular section thereby imparting to the upper portion of the carrier a three-dimensional, sculptured appearance. The center partition structure, as described above, has several additional advantages. It provides bracing and rigidity to the carrier. The downwardly-curving triangular sections reduce the height of the carrier at its end walls by about $\frac{3}{4}$ inch, thereby resulting in a saving of approximately 22 square inches of board per carrier. The full depth center partition provides double thickness protection between the two rows of bottles, and more particularly, the bottles at the corners are cushioned by virtue of the spacing apart of the partition plies by the triangular sections. The full depth center partition which exposes the printable side of the board can be used for additional advertising material. The center partition distributes the load bearing evenly down the end walls of the carrier to the bottom wall.

The end walls have serially-connected, laterally-extending, minor side flaps and double thickness dividers. The bottom wall has laterally-projecting major flaps. These major and minor flaps, together with the dividers, are adapted to enclose the carrier and provide cushioning dividers between three bottles on each side of the center partition.

In the form of the invention disclosed in the '546 patent, the dividers are more positively held in a position perpendicular to the center partition. The divider is formed with an arrowhead tab which is insertable into a slot in the minor flap to which the divider is hinged. The divider, the minor flap and the arrowhead tab thus form a right triangle with the divider perpendicular to the minor flap and the side wall when the major flap is glued in place. When the major flap is glued in place, glue applied to the projecting portion of the arrowhead tab positively secures the elements in the right triangle orientation thus positively assuring a carrier divided into six cells.

An objective of the present invention has been to provide an improvement upon the carrier described in the '546 patent. The improvement makes the carrier easier for the converter to glue and fold into a flat folded carrier and the improvement makes the carrier easier to erect by the bottler who erects the carrier and deposits bottles into the carrier.

More particularly, the improvement rests primarily in the forming of a fold line across the center of each end wall of the carrier, the fold line extending through the end wall and through the minor flaps and dividers which are attached to the end wall as will appear with greater clarity from the detailed description of the invention.

This simple expedient of providing the fold line across the middle of the end wall gives rise to several advantages.

First, at the converter the carrier blank moving through an untimed straight-line gluer can be bent slightly along the fold lines across the end walls. That slight bending tends to project the arrowheads upwardly out of the plane of the carrier blank so that glue can be applied to them as by glue rollers.

Second, as the carrier continues to move through the untimed straight-line gluer, the blank is folded along the two fold lines of the end walls to form the tube. That folding operation swings the divider flap over upon the arrowhead flap to which glue has been applied, thereby adhesively securing the arrowhead flap to the divider flap to provide a double thickness divider.

Third, the flat folded carrier presents the arrowheads on the same side of the flat folded carrier so that the arrowheads can be manipulated similarly and simultaneously by suitable plowing equipment. Further, when the arrowhead is plowed to shove it into an interlocking relationship with a slot on the minor side flap, a tendency of the minor side flap to bend is resisted by the fold line which extends across that minor side flap.

Finally, when the carrier is to be erected, the orientation of the panels is symmetrical about a transverse center line through the bottom panel and top wall which is to form a central divider. It is therefore possible to apply opposed forces to the end walls. These end walls which are folded in half will, upon application of such opposed forces, snap to a single plane which is perpendicular to the bottom wall while opposed forces applied to the top wall snap it down into the center of the carrier to form the center partition for the carrier.

The foregoing objectives and the advantages of them will become more readily apparent from the following detailed description taken in conjunction with the accompanying drawings in which.

Figure 1:
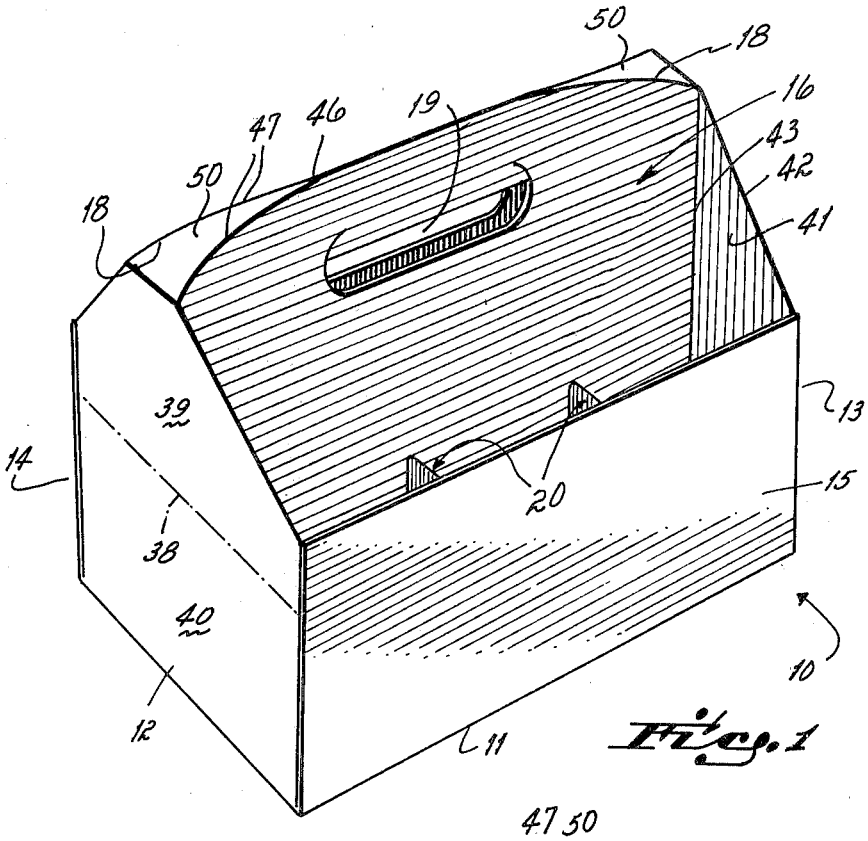
FIG. 1 is a perspective view of a carrier of the present invention.

The carrier of the present invention is indicated at 10 in FIG. 1. It has a bottom wall 11 (not shown in that figure), end walls 12 and 13, and side walls 14 and 15. A center partition 16 extends across the end walls 12, 13 down to approximately the full depth of the carrier. The partition is curved and three-dimensional as indicated at 18 at each end. A cut-out portion 19 forms a carrying handle for the carrier. Dividers 20 project inwardly from the side walls 14, 15 to divide the carrier into six cells, three on each side, into which bottles are loaded.

Figure 2:
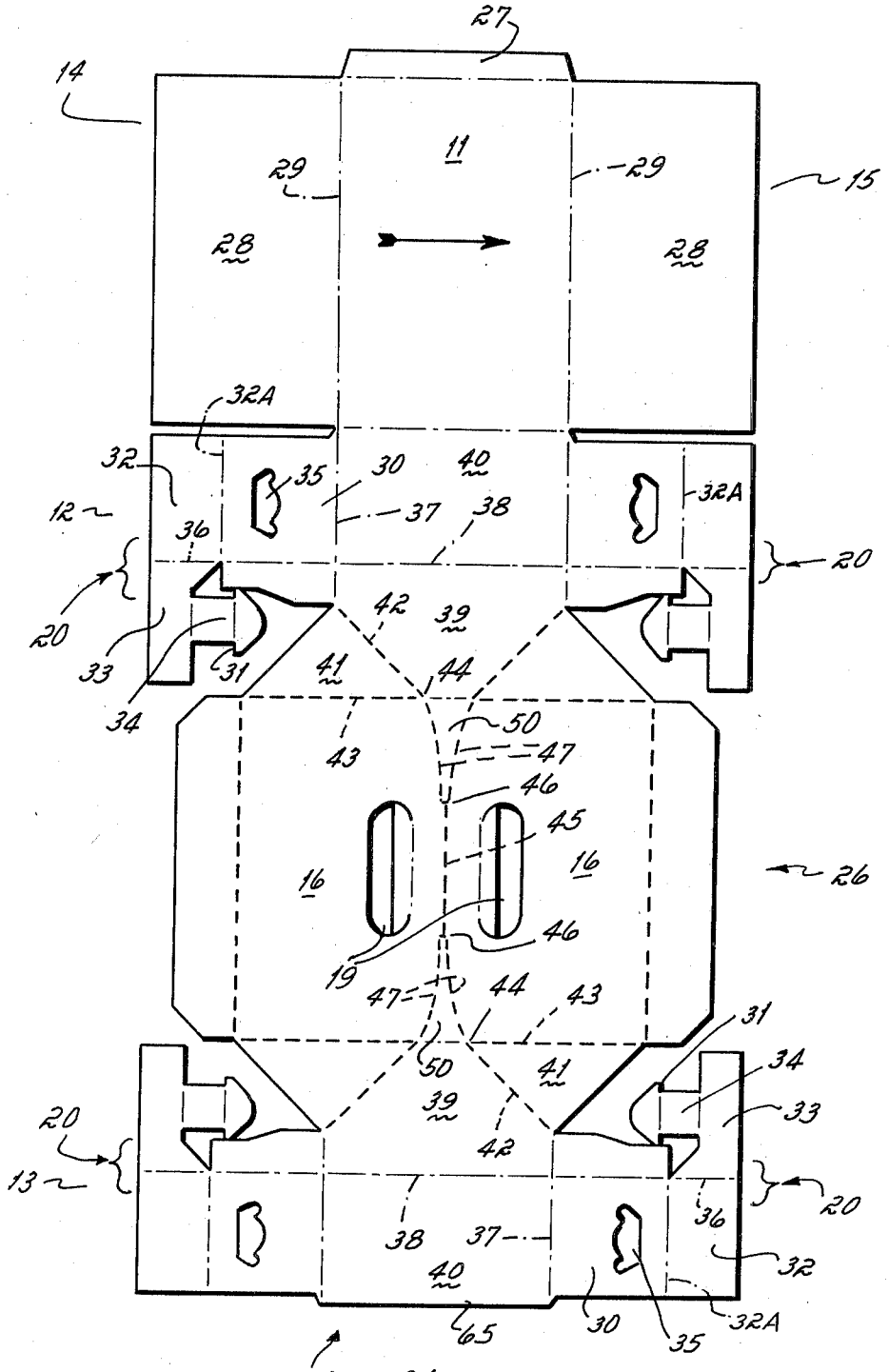
FIG. 2 is a plan view with the printed side down of the blank from which the carrier is formed.

The carrier is formed from a blank shown at 25 in FIG. 2. The blank has panels forming serially-connected bottom wall 11, end wall 12, a top wall 26 which will form the partition 16, and an end wall 13. Bottom wall 11 has a glue flap 27 which will be connected to the end wall 13 to form a tube. The bottom wall 11 also has major side flaps 28 (which form the side walls 14, 15) projecting laterally from it and hinged along score lines 29.

Each end panel 12, 13 has, serially-connected, a minor side flap 30 and the divider 20. The divider 20 is formed of two divider elements 32 and 33 which will be glued and folded upon each other to form a double thickness divider. Divider element 33 includes an arrowhead extension 34 which functions as a locking tab. It cooperates with a slot 35 cut out of minor side flap 30 so that when the divider element 33 is glued upon the divider element 32 and those divider elements are folded along a hinge line 32A, the arrowhead 34 will enter the slot 35 and the barb portion 31 of the arrowhead will prevent the arrowhead from withdrawing from the slot 35. That interlocking relationship will cause the divider elements 33, 32 to project at right angles to the minor side flap 30 and hence form permanent transverse dividers 20 when the carrier is erected. Each minor side flap 30 is connected along hinge line 37 to the respective end walls 12 and 13.

The end wall 12 has a crease or fold line 38 intermediate its ends. This crease 38 extends through the minor side flap 30 and is aligned with the crease 36 separating the two divider elements 32 and 33. Crease 38 constitutes the most significant departure of the present invention over that which is described in my '546 patent. It improves the manner in which the carrier is formed at the converter, and it affects and improves the manner in which the carrier is erected at the brewer or bottler. These features will be described hereafter.

The crease 38 divides the end wall into an upper section 39 and a lower section 40. The upper end wall section 39 includes a gusset 41 on both sides connected to it along hinge lines 42. The gusset 41 is hinged along a line 43 to the top wall 26 which forms the center partition. The gussets 41 present apexes 44.

The top wall has a central fold line 45 terminating in end points 46 which are spaced from the end walls 12, 13. The end points 46 are connected to the gusset apexes 44 by curved score line 47 which defines generally triangular-shaped sections 50.

The top panel 26 has an elongated cut-out portion 19 to form the carrier handle when the top panel is folded into the carrier to form its central partition.

Figure 7:
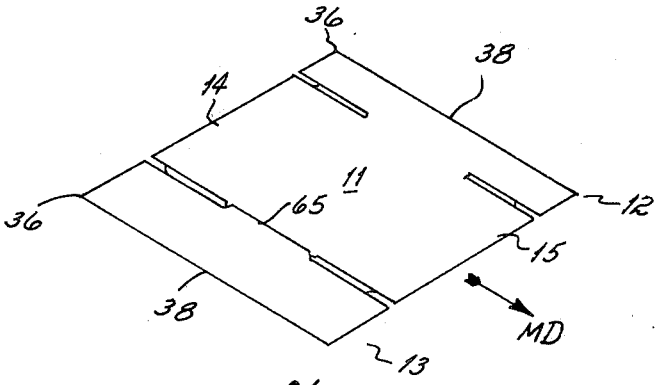

A carrier is formed from the blank of FIG. 1 in two stages. First, the blank is cut, scored, creased and glued at the converter until it is in the form of a flat folded blank as shown in FIG. 7. The blank of FIG. 7 is shipped to a bottler or brewer and is formed using the steps depicted in FIGS. 8 through 10 until it results in the carrier of FIG. 1.

Figure 3:
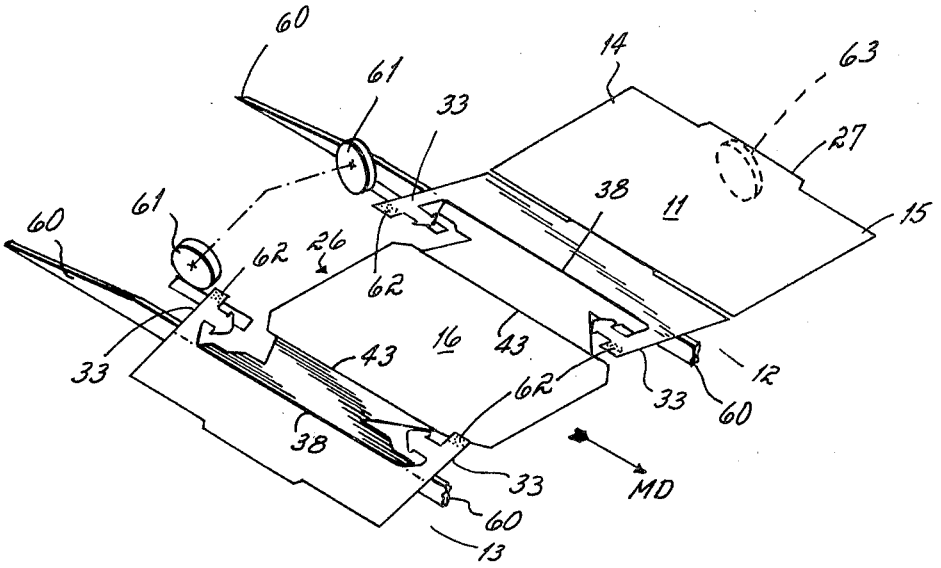
FIGS. 3 to 7 are perspective views of the sequence of steps which are performed to form a flat folded carrier at the converter.
Figure 4:
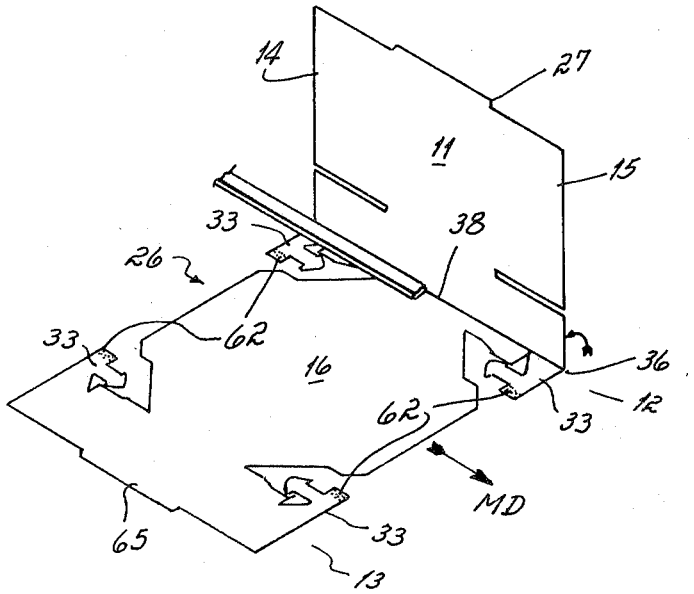

At the converter, the blank of FIG. 2 is formed and placed on a machine for gluing and folding. In such machine, the blank moves in the direction of the arrow as shown in FIG. 3. In a first stage of the operation, the blank moves over rails or other supporting structure indicated at 60 so that the blank is folded slightly on the fold lines or creases 38 which divide the end walls 12 and 13 into upper sections 39 and lower sections 40. As can be seen from FIG. 3, that slight folding operation, through about 10°, causes the divider elements 33 to project out of the plane of the upper sections 39. In that attitude, glue from glue rolls 61 can be applied to a small area indicated at 62 on each divider element 33 without any glue being applied to the upper end wall section 39. Substantially simultaneously, glue can be applied to the glue flap 27 by roller 63.

Figure 5:
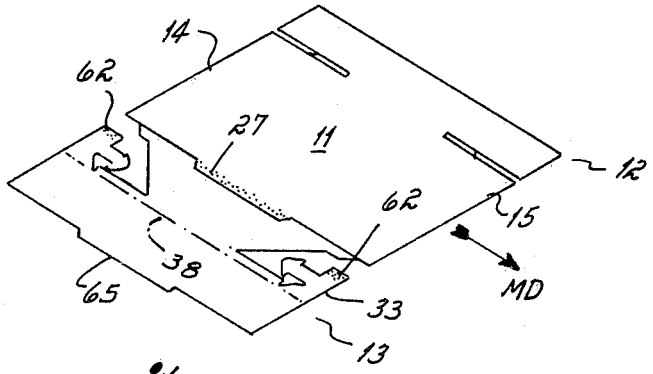
Figure 6:
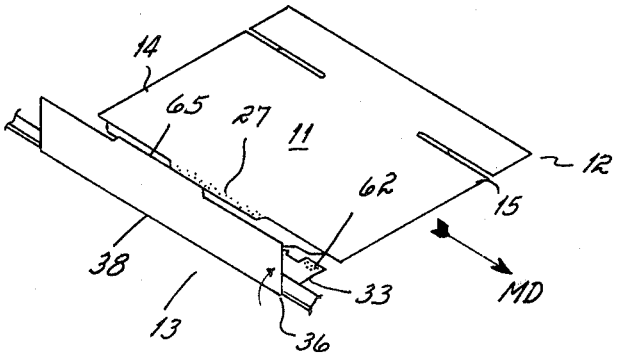

In the subsequent sequence of operations illustrated in FIGS. 4 through 7, one and one-half panels consisting of the bottom wall and the lower end wall section 40 are folded over upon the end wall upper section 39 and the top wall 26 as shown in FIG. 5. It can be observed that in that folding operation, the divider element 32 is carried over upon the divider element 33 so that the glue applied in the area 62 of element 33 can adhere to the divider element 32, thereby gluing those two elements securely together. Thereafter, the half panel consisting of the lower section 40 of the opposite end wall 13 is folded upon the upper section 39. An edge portion 65 of the lower section 40 will overlie the glue flap 27 to join the end wall 13 to the bottom wall 11. In the folding of the lower end wall section 40 over upon the upper end wall section 39 along the fold line 38, the divider element 32 is carried over upon the divider element 33, thereby securing the two divider elements together on the glued area 62, thereby completing the formation of the folded carrier blank.

At this point it can be observed that by providing the fold line 38 which divides the end walls 12 and 13 into upper and lower sections, it is possible to apply glue to the areas 62 of the divider elements 33 as they project above the plane of the upper section of the respective end wall by means of an untimed straight-line gluing mechanism. Further, the completion of the blank requires no special manipulation of the divider flaps 33 in order to glue them to the divider flaps 32 as is disclosed in the '546 patent. Rather, by folding the blank along the two newly added fold lines 38, the securing of the divider flaps 32, 33, to which glue has been applied, is effected.

At the brewer or bottler, the carrier is erected using the steps shown in FIGS. 8 through 10 and FIG. 1.

Figure 8:
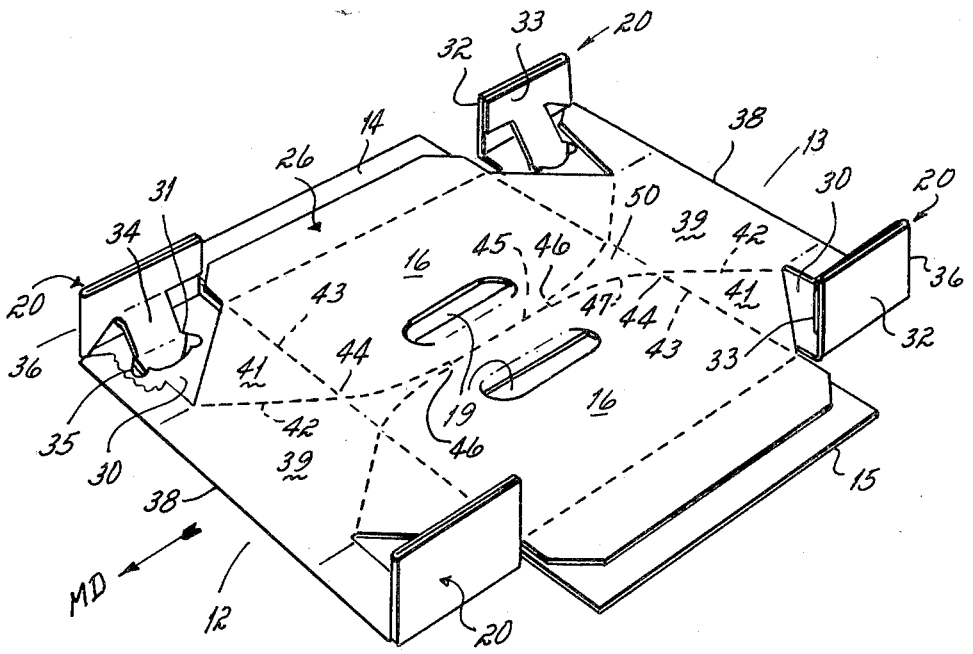

With the flat folded carrier moving in the direction of the arrow in FIG. 8, the arrowheads 34 can be plowed into the slots 35 in the minor side flaps 30 (or it can be snapped into place by hand).

Figure 9:
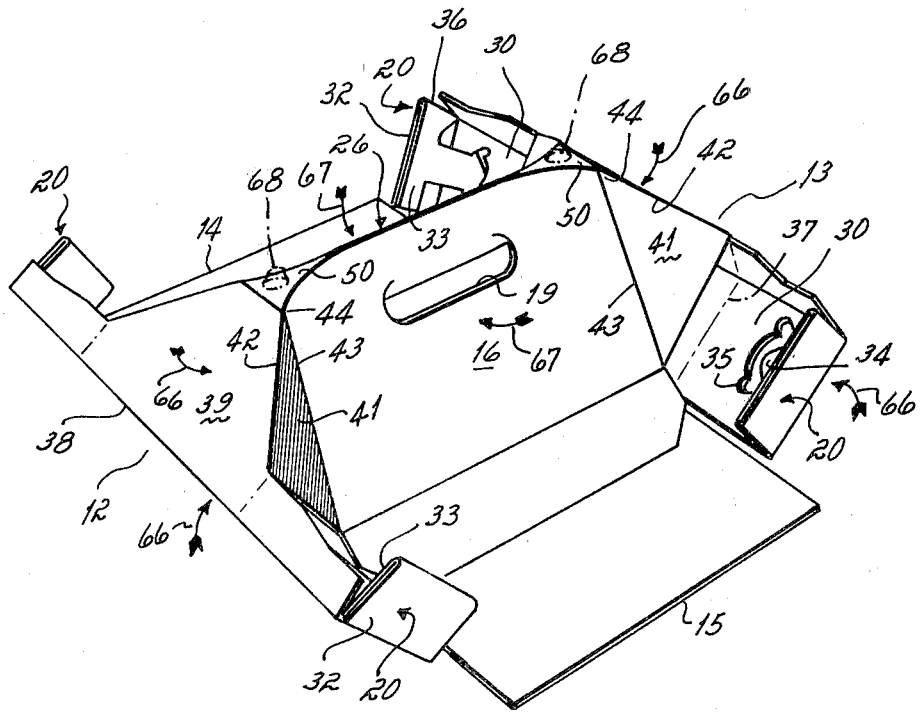

The next operation depicted in FIG. 9 involves a substantially simultaneous application of forces to the end walls 12 and 13 and to the top wall 26 in order to form it into a central partition. By applying opposed forces indicated by the arrows 66 to the end walls 12 and 13, respectively, the carrier begins to erect. By simultaneously applying opposed forces in the direction of the arrows 67, the planar top wall has its two sides swung through 90° in order to form the double thickness central divider.

On a machine, the carrier can be held in position during the application of these forces by vacuum applied by means of vacuum cups 68 which engage the small triangular top sections 50.

Figure 10:
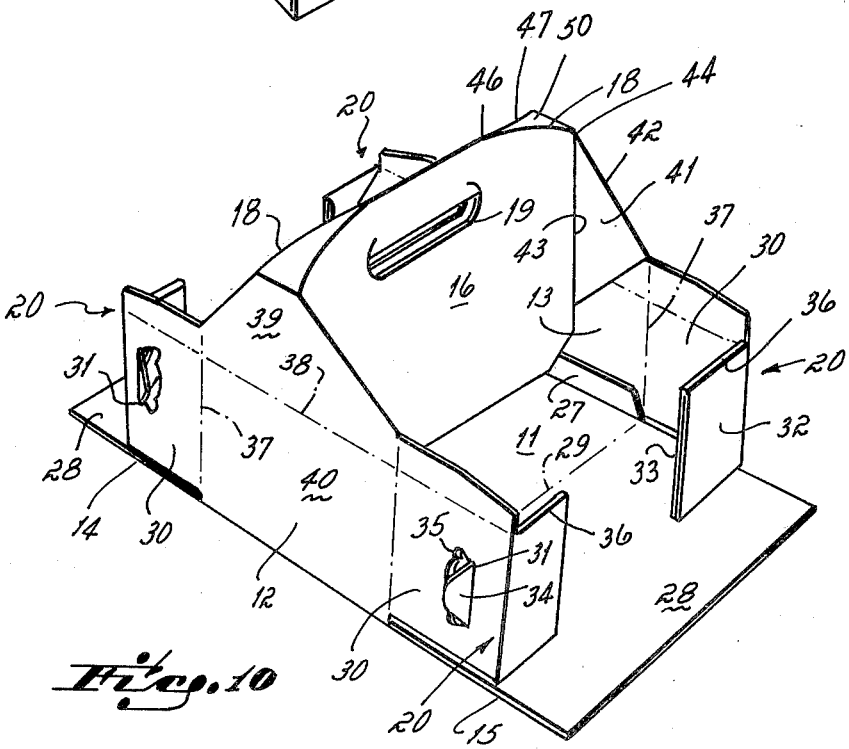
FIGS. 8 to 10 are perspective views of the sequence of steps which are used to erect the carrier from the flat folded blank.

The completion of these operations results in the carrier having the appearance depicted in FIG. 10. Thereafter, the dividers 20 are swung inwardly through 90° to divide each side of the carrier into three pockets as shown in FIG. 1. Thereafter, the major side flaps 28 have glue applied to them and are swung into a position overlying the minor side flaps 30 and are glued to the minor side flaps in order to complete the erection of the carrier. It can be seen that in gluing the major side flap 28 over the minor side flap 30, the tip of the arrowhead 34 is securely locked into position and will maintain the dividers 20 in a position parallel to each other and perpendicular to both the center partition and the side walls 15 of the carrier.

From the foregoing description, it can be seen that the introduction of the fold lines 38 which divide the end walls into upper and lower sections 39 and 40 provide two beneficial features. First, all four arrowheads, which must be manipulated before the carrier is erected, are on the same side of the carrier where they can be more easily handled. Second, in the setting up of the carrier through the stages of FIGS. 9 and 10, the carrier is erected by the symmetrical application of forces to the end walls and to the top wall. This is in contrast to the prior construction of the '546 patent. In that patent, the carrier was first erected into a tubular form and thereafter forces were applied to the top wall and to two gussets connecting the top wall to the end walls in order to create the central divider. These somewhat awkward manipulations have been replaced by the simultaneous application of forces as illustrated in FIG. 9.

Having described my invention, I claim:

1. In a carrier blank having, serially, a bottom wall, a first end wall connected by a crease to said bottom wall, a panel having a central crease and forming a center partition and connected to said first end wall, a second end wall connected at one end to said panel and at the other end by a crease to said bottom wall, means forming side walls, and a gusset integrally connecting said panel to said end walls on each side of said central crease, the improvement comprising:

a transverse fold line parallel to said bottom wall creases intermediate the ends of each of said end walls, said carrier in a flat folded condition having said center partition-forming panel overlying said bottom wall and said end walls being folded upon themselves along said fold lines, whereby said carrier can be erected by simultaneously applying opposing inward pressure on said end walls and downward pressure on said panel on each side of said central crease.

2. A flat folded carrier comprising, a bottom wall and outboard end wall lower sections hinged on creases to opposite ends of said bottom wall, a panel which has a longitudinal and central crease for forming a center partition, outboard end wall upper sections hinged to said lower sections along fold lines which are parallel to said bottom wall creases, said upper sections being integrally connected to said panel on each side of said center partition by a gusset hinged to opposite ends of said center partition-forming panel, and means forming side walls connected to said bottom wall, said panel overlying said bottom wall, whereby said carrier can be erected by simultaneously applying inward pressure to said end wall sections and downward pressure to said panel on each side of said central crease.

3. The method of erecting said carrier of claim 2 comprising the steps of:

applying opposing inward forces to said end wall sections to cause the end walls to be formed perpendicularly to said bottom wall while simultaneously applying opposing downward forces to said panel to fold it inwardly to create a center partition between said end walls.

4. A blank as in claim 1 further comprising, a minor flap hinged on a longitudinal line to each side of said end wall, a divider element hinged on a longitudinal line to said minor flap, an arrowhead hinged along a transverse line, coinciding with said end wall fold line, to said divider element and adapted to be folded and glued upon said divider element, whereby a folded carrier may be formed by:

bending said blank about said end wall fold lines to cause said arrowheads to project above the plane of said blank, applying glue to said arrowheads, simultaneously folding end walls along said fold line, folding said arrowheads onto said divider elements, and connecting said bottom wall to said second end wall.

* * * * *